US007600746B2

(12) United States Patent
Chino

(10) Patent No.: US 7,600,746 B2
(45) Date of Patent: Oct. 13, 2009

(54) CASSETTE AND IMAGE FORMING APPARATUS

(75) Inventor: Hiroki Chino, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/126,535

(22) Filed: May 23, 2008

(65) Prior Publication Data

US 2008/0296831 A1 Dec. 4, 2008

(30) Foreign Application Priority Data

May 30, 2007 (JP) ..... 2007-143663

(51) Int. Cl.
*B65H 3/44* (2006.01)

(52) U.S. Cl. ..... 271/9.11; 271/9.08

(58) Field of Classification Search ..... 271/9.01, 271/9.08, 9.11
See application file for complete search history.

(56) References Cited

U.S. PATENT DOCUMENTS 6,547,234 B1 * 4/2003 Quesnel ..... 271/9.08
6,659,443 B1 * 12/2003 Eskey ..... 271/9.08
6,776,405 B2 * 8/2004 Eskey ..... 271/9.08
7,403,739 B2 * 7/2008 Hwang ..... 399/391

FOREIGN PATENT DOCUMENTS

| | | |
|---|---|---|
| JP | 04-303334 | 10/1992 |
| JP | 04-365731 | 12/1992 |
| JP | 2002-321838 | 11/2002 |
| JP | 2006-199403 | 8/2006 |
| JP | 2006-273567 | 10/2006 |

* cited by examiner

*Primary Examiner*—Kaitlin S Joerger
(74) *Attorney, Agent, or Firm*—Workman Nydegger

(57) ABSTRACT

A cassette is used by being mounted on an image forming apparatus body and can be accommodated in a state where media, which will be supplied to the image forming apparatus body, are loaded. The cassette includes a first tray, a second tray, a slide mechanism, and a power transmission mechanism. The first tray is able to contain multiple media. The second tray is able to contain multiple media. The slide mechanism allows the first tray and the second tray to be movable relative to each other. The power transmission mechanism moves the first tray and the second tray relative to each other by input power in a direction in which a paper feeding tray can be switched. The power transmission mechanism is provided with a gear that receives the power, wherein the gear can be displaced in a cassette insertion direction in which the cassette is inserted.

5 Claims, 10 Drawing Sheets

CASSETTE AND IMAGE FORMING APPARATUS

BACKGROUND

1. Technical Field

The present invention relates to a cassette that has a tray, which contains media, such as sheets of paper, and that is mounted on an image forming apparatus body in order to supply the media and an image forming apparatus that is provided with the cassette.

2. Related Art

In an existing art, a cassette-type paper feeding system in which a cassette that loads and contains sheets of paper as media is mounted on a printer body to feed paper is known as a paper feeding system of a printer, which is an image forming apparatus of this type. The cassette contains one type of sheets of paper. When the paper size is changed, the cassette needs to be manually replaced. In addition, there is known a feeding system that is provided with a divider for each paper size in the tray of a cassette in order to be able to support multiple types of paper size, which is, for example, described in JP-A-2002-321838.

However, the cassette described in JP-A-2002-321838 needs to be replaced manually, so that it is troublesome. For example, when a network is established between a personal computer (PC) and a printer, there is a possibility that a distance from the PC to the printer is long. In this case, when a user specifies different sheets of paper to perform printing of multiple jobs, the user has been required to go and come between the PC and the printer several times in order to replace the cassette to the one of the specified paper size.

SUMMARY

An advantage of some aspects of the invention is that it provides a cassette that is able to switch a feeding tray even when the cassette is not replaced and also provides an image forming apparatus.

An aspect of the invention provides a cassette. The cassette is used by being mounted on an image forming apparatus body and can be accommodated in a state where media, which will be supplied to the image forming apparatus body, are loaded. The cassette includes a first tray, a second tray, a slide mechanism, and a power transmission mechanism. The first tray is able to contain multiple media. The second tray is able to contain multiple media. The slide mechanism allows the first tray and the second tray to be movable relative to each other. The power transmission mechanism moves the first tray and the second tray relative to each other by input power in a direction in which a paper feeding tray can be switched. The power transmission mechanism is provided with a gear that receives the power, wherein the gear can be displaced in a cassette insertion direction in which the cassette is inserted. Note that the aspect of the invention does not limit the number of trays to two, that is, the first tray and the second tray, but it may include the configuration of a cassette that is provided with three or more trays as far as the first tray and the second tray are included.

When the cassette is mounted on the image forming apparatus body, for example, power from a power source provided on the image forming apparatus body side is input to the power transmission mechanism, and the first tray and the second tray move relative to each other by the power input to the power transmission mechanism. Because the first tray and the second tray move relative to each other, it is possible to switch a paper feeding tray, which feeds media, between the trays. Thus, a feeding tray may be switched even when the cassette is not replaced. In addition, because the cassette does not need to have a power source, the configuration of the cassette may be relatively simple. In addition, when the cassette is pushed in to the end in the insertion direction in order to mount it on the image forming apparatus, even when the teeth of an output gear on the image forming apparatus side are not engaged with the teeth of an input gear but abut against the teeth of the input gear, the input gear displaces in a direction opposite to the cassette insertion direction, so that it is possible to avoid a large load from being applied between the teeth.

In the cassette according to the aspect of the invention, the power transmission mechanism may include a rack and a pinion, wherein the rack is provided for one of the first tray and the second tray, and wherein the pinion, which serves as the gear, is provided for the other of the first tray and the second tray and is engaged with the rack.

According to the above aspect, rotation of the pinion on the basis of the power input to the power transmission mechanism is transmitted to the rack through the engagement of the pinion and the rack and, therefore, the first tray and the second tray move relative to each other. By employing the rack and pinion that is a relatively simple and space-saving mechanism, it is possible to achieve automatic switching of a tray while avoiding an increase in size of the cassette as much as possible.

In the cassette according to the aspect of the invention, the pinion may be at least open to a cassette insertion direction side. According to the above aspect, when the cassette is mounted on the image forming apparatus, the output gear of a driving mechanism that outputs power from the power source on the image forming apparatus side may be arranged at a portion (free space) at which the pinion is open on the cassette insertion direction side. Thus, the pinion, which serves as an input gear, may be engaged with the output gear on the image forming apparatus side so as to be able to transmit power.

The cassette according to the aspect of the invention may further include an urging device that urges the pinion in the cassette insertion direction. According to the above aspect, when the cassette is mounted, even when the teeth of the pinion abut against the teeth of the output gear, because the pinion displaces in a direction opposite to the cassette insertion direction against the urging force of the urging device, it is possible to avoid a large load from being applied between the teeth. Then, when at least one of the pinion and the output gear rotates and thereby the teeth of them are positioned so as to be engageable, because the pinion is urged by the urging force of the urging device toward the output gear, it is possible to reliably engage the teeth of them.

Another aspect of the invention provides an image forming apparatus. The image forming apparatus includes the cassette according to the above aspect of the invention and an image forming apparatus body that has a mounting portion on which the cassette can be mounted, wherein the image forming apparatus body is provided with a driving gear that is engaged with the power transmission mechanism so as to be able to transmit power in a state where the cassette is mounted on the mounting portion.

According to the above aspect, because the power transmission mechanism is engaged with the driving gear on the image forming apparatus body side in a state where the cassette is mounted on the mounting portion of the image forming apparatus body, the power from the power source on the image forming apparatus body side is transmitted to the power transmission mechanism through the engagement of the driving gear and the power transmission mechanism, so that the first tray and the second tray move relative to each other on the basis of the transmitted power. Thus, the same advantageous effects as those of the cassette according to the above aspect of the invention may be obtained.

In the image forming apparatus according to the aspect of the invention, the image forming apparatus body may include a power source that outputs power for rotating the driving gear, wherein, in a state where the cassette is mounted on the mounting portion, a rotary force of the driving gear on the basis of the power of the power source is transmitted to the power transmission mechanism that is engaged with the driving gear to thereby move the first tray and the second tray relative to each other.

According to the above aspect, in a state where the cassette is mounted on the image forming apparatus body, rotation of the driving gear on the basis of the power of the power source on the image forming apparatus body is transmitted to the power transmission mechanism on the cassette side through the engagement with the driving gear. Thus, the first tray and the second tray move relative to each other. The same advantageous effects as those of cassette according to the aspect of the invention are obtained and, in addition, because the power from the power source on the image forming apparatus body side is used, it is not necessary to provide a power source on the cassette side. For example, it is possible to achieve a simple, small-sized, light weight structure of the cassette.

In the image forming apparatus according to the aspect of the invention, the image forming apparatus body may include a pick-up roller that is driven so as to be able to deliver media on the cassette that is mounted on the mounting portion, wherein the first tray and the second tray, when the cassette is mounted, may be movable relative to each other between a first position at which the pick-up roller contacts an uppermost medium among media loaded on the first tray and a second position at which the pick-up roller contacts an uppermost medium among media loaded on the second tray, wherein a tray from which the pick-up roller delivers media may be switched in such a manner that a relative position between the first tray and the second tray is switched between the first position and the second position by power input to the power transmission mechanism.

According to the above aspect, the relative position between the first tray and the second tray is switched between the first position and the second position by the power input to the power transmission mechanism, so that switching of a tray that the pick-up roller delivers media is performed. Thus, switching of the tray that delivers media may be performed not by manual operation but by automatic operation.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
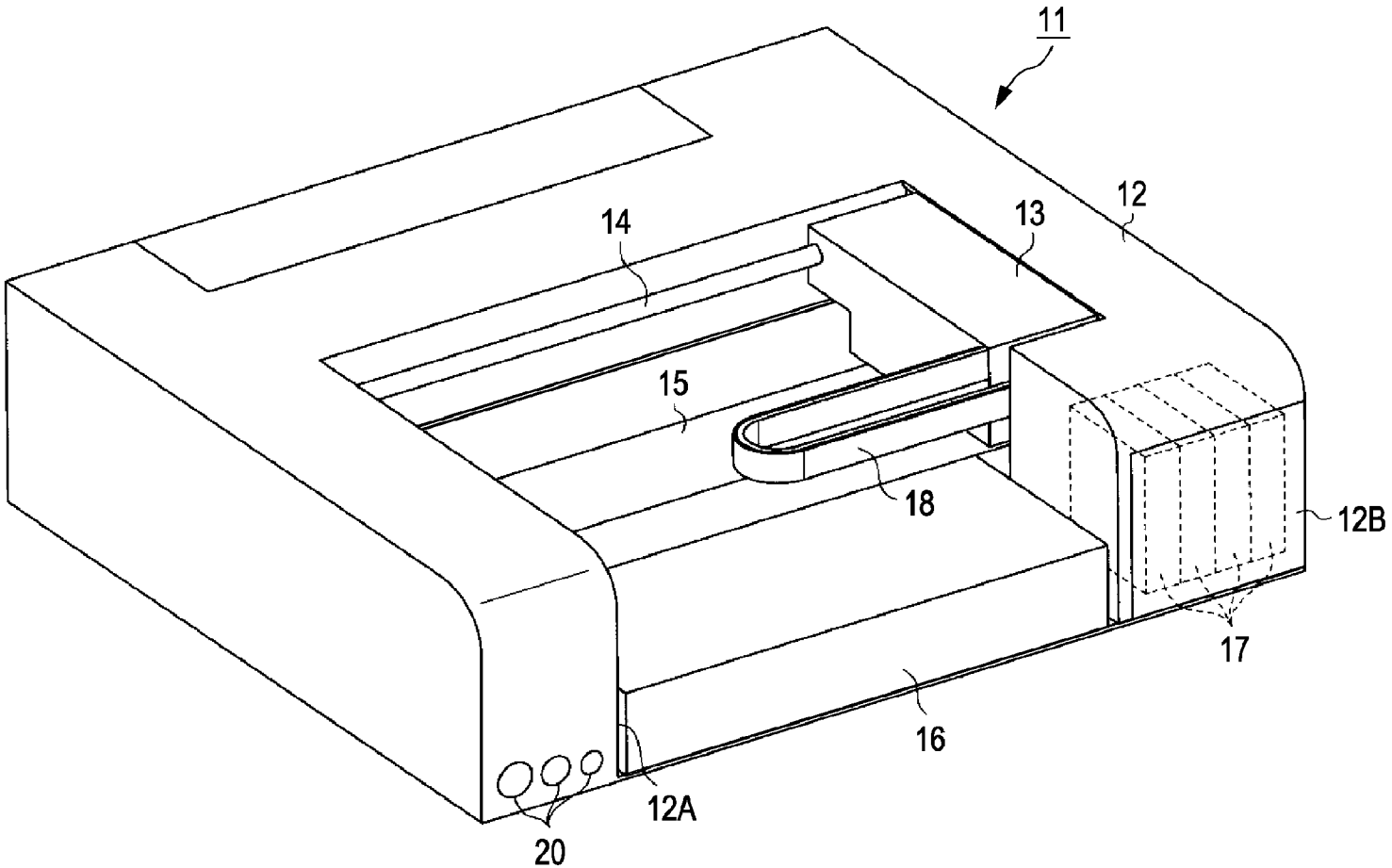
FIG. 1 is a perspective view of a printer according to an embodiment.

Hereinafter, an embodiment of the invention will be described with reference to FIG. 1 to FIG. 10. FIG. 1 is a perspective view that shows a printer, which serves as an image forming apparatus, according to the present embodiment. As shown in FIG. 1, the printer 11 has a rectangular box-shaped main body 12. Around the center of the main body 12, a carriage 13 is provided so as to move reciprocally in a main scanning direction in such a manner that the carriage 13 is guided by a guide shaft 14 that is provided so as to extend in a lateral direction (main scanning direction) in FIG. 1.

As shown in FIG. 1, around the center of the main body 12, a long plate-like platen 15 is arranged at a lower position that faces the carriage 13 so that the longitudinal direction of the platen 15 is parallel to the main scanning direction. At the front face (the face facing toward the front in FIG. 1) and lower portion of the printer 11, a paper feeding cassette 16 is mounted (inserted) in a recessed mounting portion 12A, which is formed in the main body 12 so that the front side is open, in a state where it may be inserted or removed. In addition, a cover 12B covers the right end front face of the main body 12 and a plurality of ink cartridges 17 are loaded inside the cover 12B. Inks of the ink cartridges 17 are respectively supplied to the carriage 13 through a plurality of ink supply tubes (not shown) provided for a flexible wiring substrate 18, and then ink droplets are ejected (discharged) from a print head 19 (shown in FIG. 2) that is provided at the lower portion of the carriage 13. Note that the print head 19 is internally provided with a pressurizing element (piezoelectric element, electrostatic element, heater element, or the like), which applies an ink with pressure for ejecting the ink, in each nozzle. When a predetermined voltage is applied to the pressurizing element, ink droplets are ejected (discharged) from the corresponding nozzle.

During printing, ink droplets are ejected from the print head 19 in process of moving in the main scanning direction together with the carriage 13 onto a sheet of paper that is fed from the cassette 16 and located on the platen 15. In this manner, printing of one line is performed. Thus, printing operation by one scanning of the carriage 13 and paper transport operation to the next line are alternately repeated to thereby proceed with printing on the sheet of paper. In addition, at the left end front face lower portion of the main body 12, various operating switches 20 that include a power switch are provided.

Figure 2:
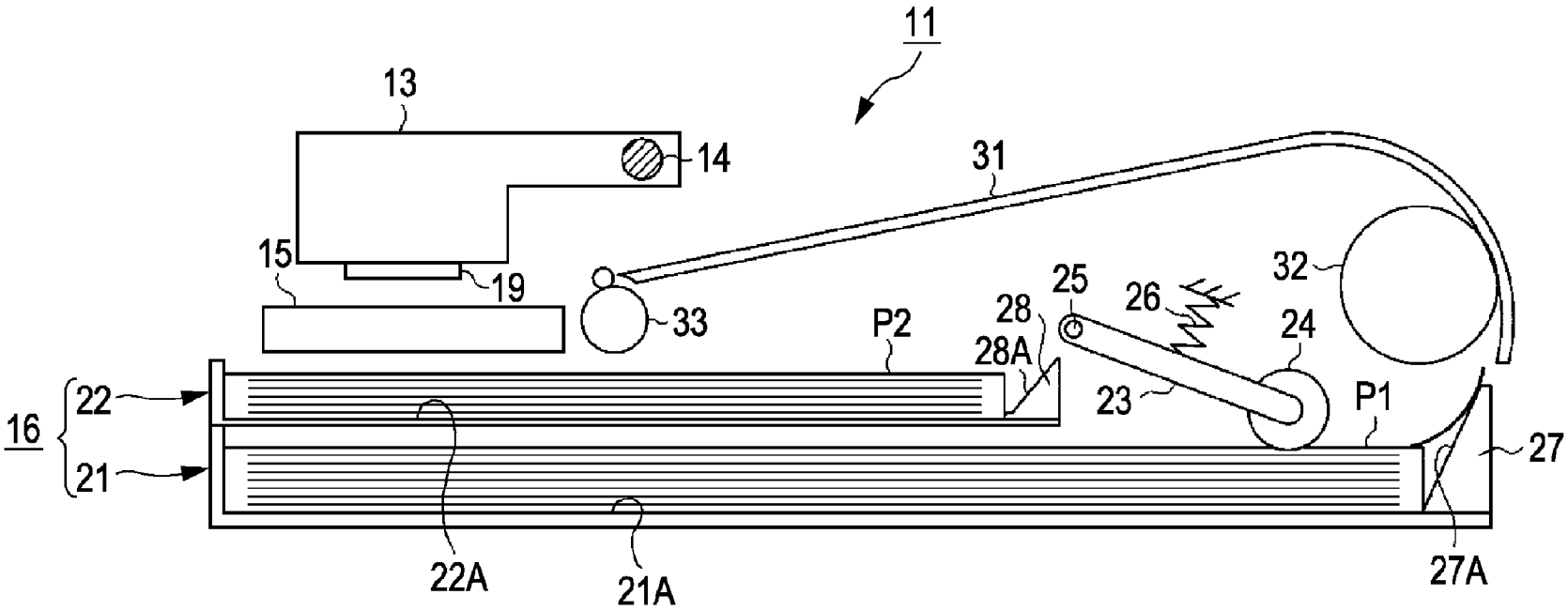
FIG. 2 is a schematic longitudinal cross-sectional view that shows a paper feeding mechanism of the printer.
Figure 3:
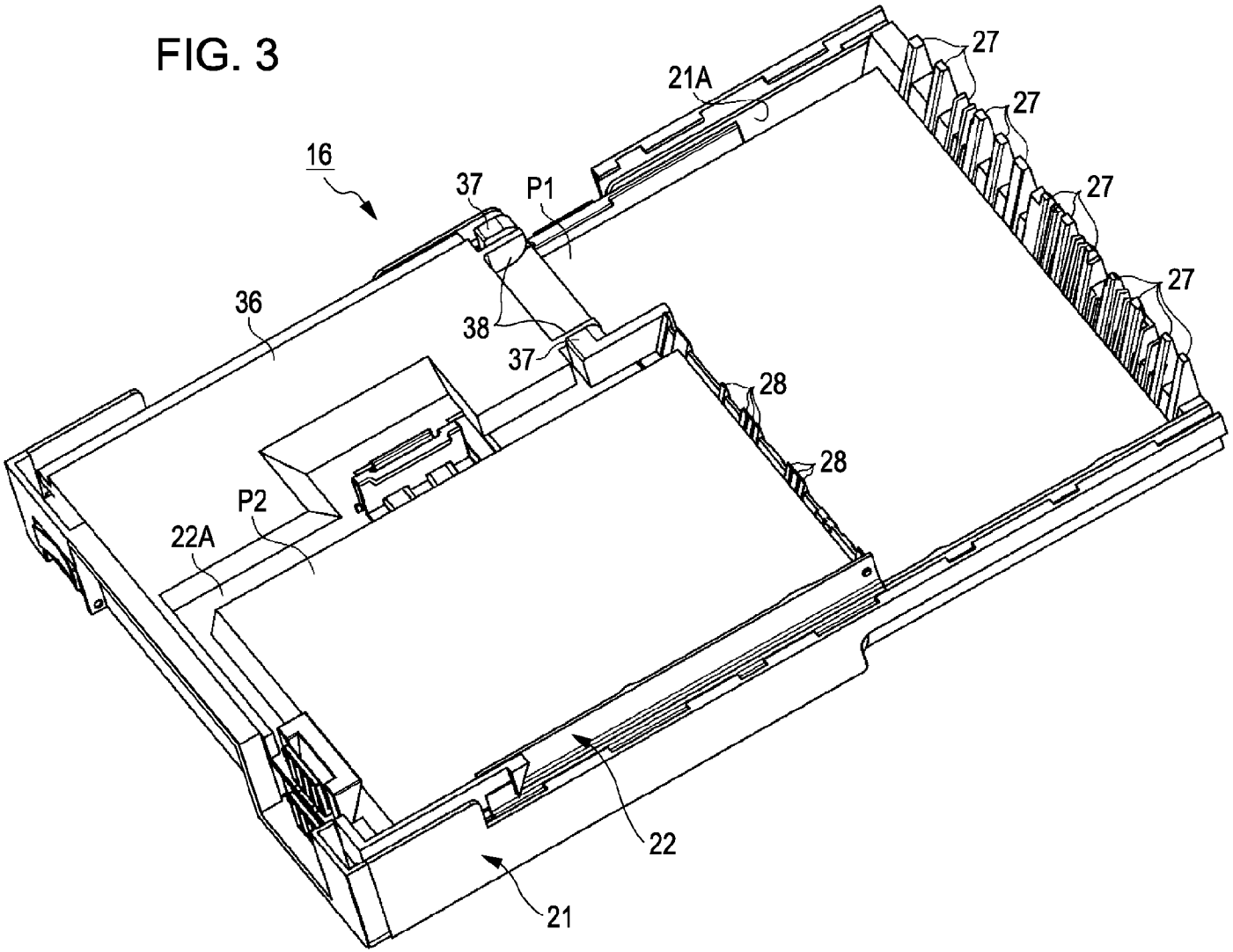
FIG. 3 is a perspective view that shows a cassette in a state where a second tray is located at a retracted position.
Figure 4:
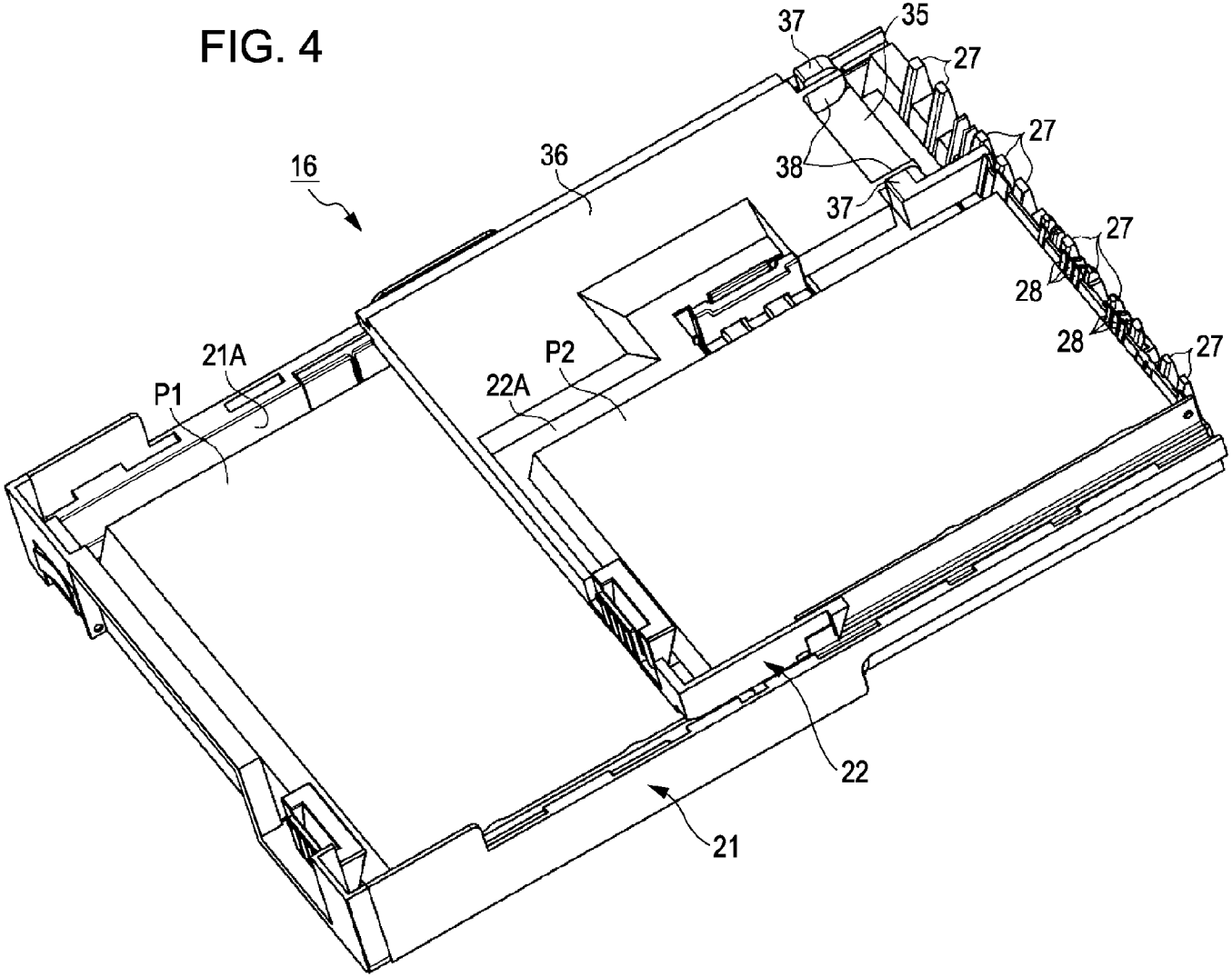
FIG. 4 is a perspective view of the cassette in a state where the second tray is located at a paper feeding position.

FIG. 2 is a longitudinal cross-sectional view of a paper feeding mechanism in a state where the cassette is mounted. In addition, FIG. 3 and FIG. 4 are perspective views of the cassette, respectively. As shown in FIG. 2 to FIG. 4, the cassette 16 includes a first tray 21 and a second tray 22. The first tray 21 is capable of containing large-sized (for example, A4 size) sheet of paper PT. The second tray 22 is capable of containing a small-sized (for example, L size, 2L size, or postcard size) sheet of paper P2. The cassette 16 has a double structure in which the second tray 22 is placed above the first tray 21 (upper side in a paper loading direction) so as to be movable with respect to a cassette insertion/removal direction (lateral direction in FIG. 2).

In the cassette 16 shown in FIG. 2, the second tray 22 is located at a retracted position at which the second tray 22 is retracted to a side (cassette remove direction) opposite to a direction (hereinafter, referred to as cassette insertion direction), in which the cassette 16 is inserted into a mounting portion 12A of the printer T1, with respect to the upper side of the first tray 21. As shown in FIG. 2, a pick-up roller 24 is arranged inside the printer 11 at a position that faces the insertion distal end upper position of the cassette 16 set at the mounting portion 12A and is provided rotatably at the distal end of a lever 23 that is pivotally supported on the main body frame. The lever 23 is urged by a spring 26 in a direction in which the pick-up roller 24 is pressed against the upper face of the sheets of paper P1 (or P2).

At the distal end positions in the cassette insertion direction of the first tray 21 and the second tray 22, and separation portions 27 and 28 that separate only the uppermost sheet of paper from other lower (lower side layer) sheets of paper to be fed among the loaded sheet of paper P1 or P2 respectively extend upward. The separation portion 27 or 28 respectively has an oblique surface 27A or 28A of a predetermined angle at which the distal end of a sheet of paper can abut against the oblique surface 27A or 28A on the way the sheet of paper is delivered from the tray by the pick-up roller 24.

As shown in FIG. 2, when the pick-up roller 24 is driven for rotation in a state where the pick-up roller 24 is in contact with the upper face of the sheet of paper P1 loaded in the containing recess 21A of the first tray 21, the sheet of paper P1 is delivered in a direction (toward the right hand side in FIG. 2) opposite to a paper feeding direction (toward the left hand side in FIG. 2). On the way of this delivery, as the distal end of the sheet of paper P1 abuts against the oblique surface 27A of the separation portion 27, only the uppermost sheet of paper is separated from other sheets of paper and then the separated sheet of paper P1 is guided along the oblique surface 27A upward, and thereafter the uppermost sheet of paper P1 is introduced into an introducing port between a paper feeding guide 31 and a paper feeding roller 32.

The paper feeding guide 31 is formed into a curved plate-like shape at the rear end side (at the right end side in FIG. 2) so as to be able to reverse a sheet of paper to thereby form a feeding path of the sheet of paper. The sheets of paper that is delivered to the rear side from the tray (first tray 21 in FIG. 2) by the rotation of the pick-up roller 24 abut against the oblique surface 27A of the separation portion 27 at the distal ends thereof, so that only the uppermost sheet of paper is separated from the other lower layer sheets of paper. The separated sheet of paper is guided by the oblique surface 27A of the separation portion 27 and introduced into the introducing port located on the upper side, and is further delivered along the paper feeding guide 31 by the rotation of the paper feeding roller 32, so that the sheet of paper is reversed at the curved face portion. After the reversal, the sheet of paper is transported from the rear side toward the front side (toward the left hand side in FIG. 2), and then is nipped (held) between a pair of transport rollers 33. Then, the sheet of paper is transported and fed onto the platen 15 by the rotation of the pair of transport rollers 33. Then, ink droplets are ejected from the print head 19 onto the sheet of paper placed on the platen 15, and printing is thus performed.

On the other hand, a pivot shaft 25, which is a pivot fulcrum of the lever 23, is located at a position higher than a position at which the second tray 22 is arranged. In the process in which the second tray 22 moves from the retracted position shown in FIG. 2 or FIG. 3 to the paper feeding position shown in FIG. 4, when the second tray 22 is arranged at the paper feeding position while pushing aside the lever 23, the pick-up roller 24 runs on the upper face of the sheets of paper P2 loaded on the second tray 22 and is arranged so as to push the upper face of the small-sized sheets of paper P2 loaded on the second tray 22. Thus, when the second tray 22 is arranged at the paper feeding position, the small-sized sheets of paper P2 loaded on the second tray 22 are delivered in the delivery direction by the rotation of the pick-up roller 24. Then, after the distal ends of the delivered sheets of paper P2 abut against the oblique surface 28A of the separation portion 28 and then an uppermost sheet of paper is separated from other sheets of paper (lower layer sheets of paper), the separated sheet of paper is fed by the paper feeding roller 32 along the inner face of the paper feeding guide 31 from the rear side toward the front.

As shown in FIG. 2 to FIG. 4, the first tray 21 has a substantially rectangular box shape that is slightly larger in size than A4 size and that has an opening at its upper side. The first tray 21 has a rectangular containing recess 21A inside as viewed in plan, the containing recess 21A can contain an A4 size sheet of paper P1. The second tray 22 has a width that is substantially equal to that of the first tray 21, and the length thereof in the cassette insertion/removal direction (longitudinal direction) is formed slightly longer than half the overall length in the longitudinal direction of the first tray 21. The second tray 22 is configured to move between the retracted position, shown in FIG. 3, which is a relative position at which the front side face of the second tray 22 aligns with that of the first tray 21, and the paper feeding position, shown in FIG. 4, which is a relative position at which the end face in the cassette insertion direction of the second tray 22 aligns with that of the first tray 21. Thus, within a range in which the second tray 22 moves relative to the first tray 21, the second tray 22 never protrudes from the first tray in the longitudinal direction.

Figure 5:
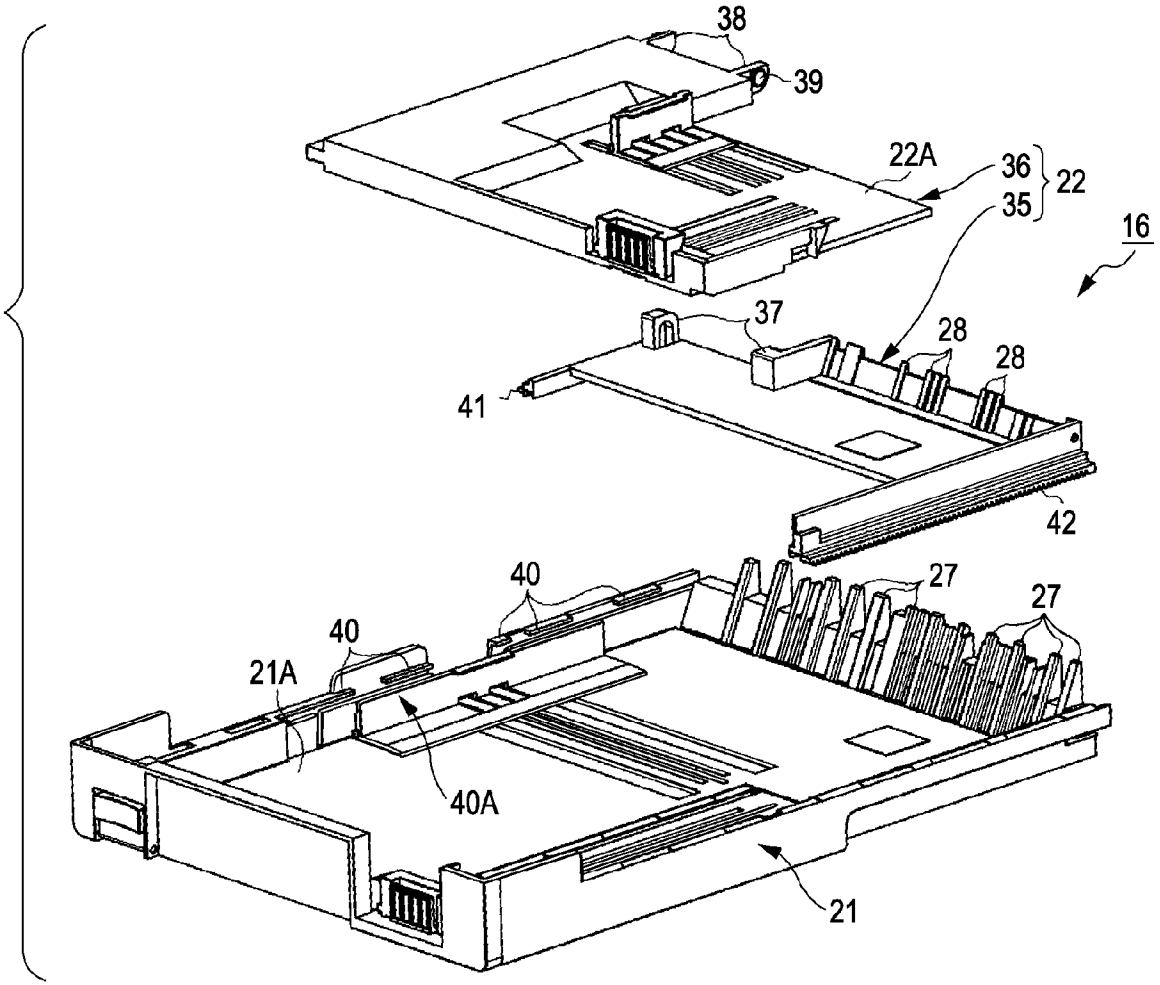
FIG. 5 is an exploded perspective view of the cassette.

FIG. 5 is an exploded perspective view of the cassette. As shown in FIG. 5, the cassette 16 includes the first tray 21 and the second tray 22. Moreover, the second tray 22 includes two components, that is, a support board 35 and a pivot cover 36. The width of each of the support board 35 and the pivot cover 36 (width in a direction that is perpendicular to the cassette insertion/removal direction) is substantially equal to the width of the first tray 21. The support board 35 is fitted to the first tray 21 so as to be slidable in the cassette insertion/removal direction, so that the second tray 22 is movable relative to the first tray 21. A pair of connecting portions 37 that extend from the upper face of the support board 35 at one end portion and shaft portions 39 of a pair of connecting pieces 38 that extend from the end portion of the pivot cover 36 are coupled so as to be pivotable, so that the pivot cover 36 is pivotable so as to open or close vertically about the shaft portions 39 with respect to the support board 35.

Thus, in FIG. 4, when sheet of paper are added in the containing recess 21A of the first tray 21, the area of opening may be ensured widely when the sheets of paper are contained in the first tray 21 by pivoting the pivot cover 36 upward, so that it is easy to add the sheets of paper to the first tray 21. That is, because the cassette 16 has a double structure formed of the first tray 21 and the second tray 22, half the upper side or more of the first tray 21 is covered with the second tray 22; however, the second tray 22 has a pivot structure in which the pivot cover 36 is pivotable, so that it is easy to add the sheets of paper to the first tray 21.

In addition, as shown in FIG. 5, a plurality of guide portions 40 are formed at each side on the inner face upper portion of the first tray 21 so as to extend intermittently along the longitudinal direction, and these plurality of guide portions 40 and the upper end faces of the step portions that face the guide portions 40 at the lower side cooperate to form recessed rail guides 40A (however, only the one on the one side is shown). Then, rail portions 41 (only the one on the left side is shown), formed of a protrusion strip extending substantially vertically outward are formed at both outer side portions of the support board 35. The second tray 22 is configured to be slidable in the cassette insertion/removal direction (lateral direction in FIG. 2) with respect to the first tray 21 in such a manner that the rail portions 41 are engaged with the recessed rail guides 40A. Note that, in the present embodiment, a slide mechanism is formed of the recessed rail guides 40A and the rail portions 41.

In addition, a rack 42 is formed at the right side lower end portion of the support board 35 so as to extend in the cassette insertion/removal direction. The rack 42 constitutes a part of a power transmission mechanism 48 (shown in FIG. 6A to FIG. 7B) that transmits power for moving the second tray 22 relative to the first tray 21.

Figure 6A:
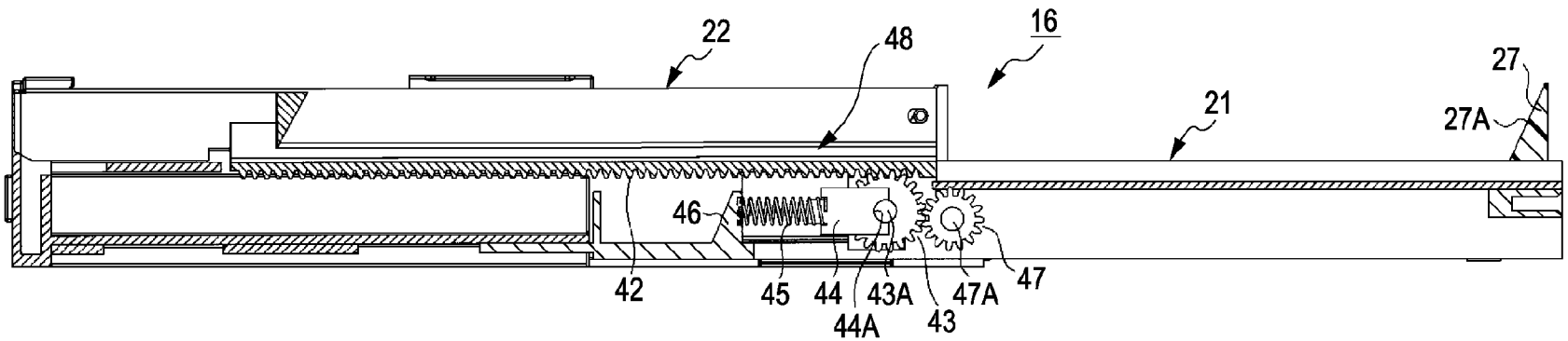
FIG. 6A is a longitudinal cross-sectional view that shows the cassette in a state where the second tray is located at the retracted position.
Figure 6B:
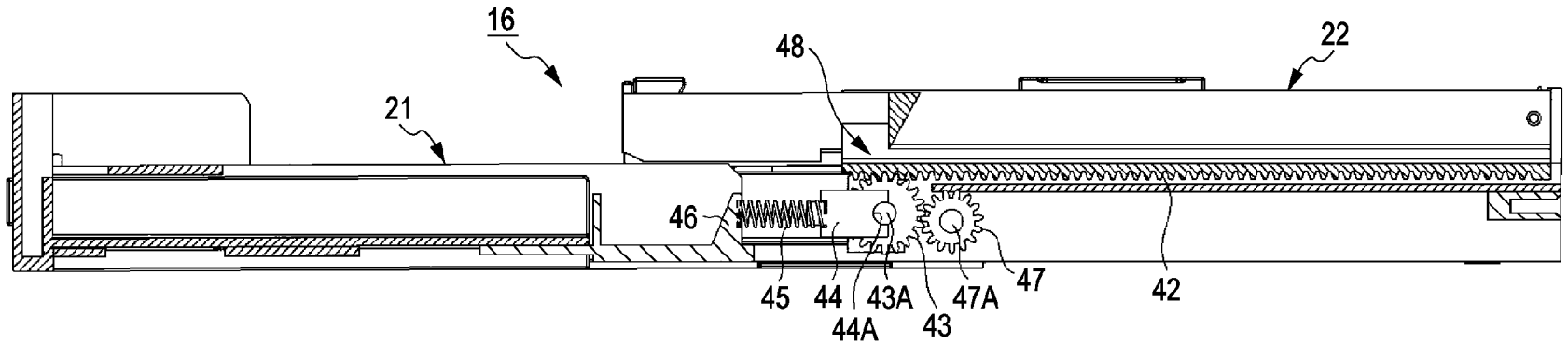
FIG. 6B is a longitudinal cross-sectional view that shows the cassette in a state where the second tray is located at the paper feeding position.
Figure 7A:
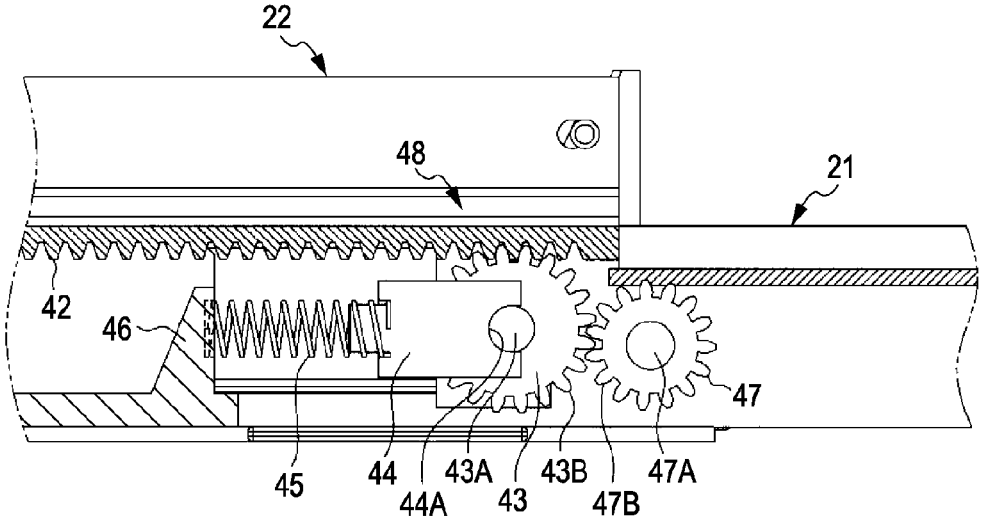
FIG. 7A and FIG. 7B are partially longitudinal cross-sectional views, each of which shows a power transmission mechanism of the cassette.
Figure 7B:
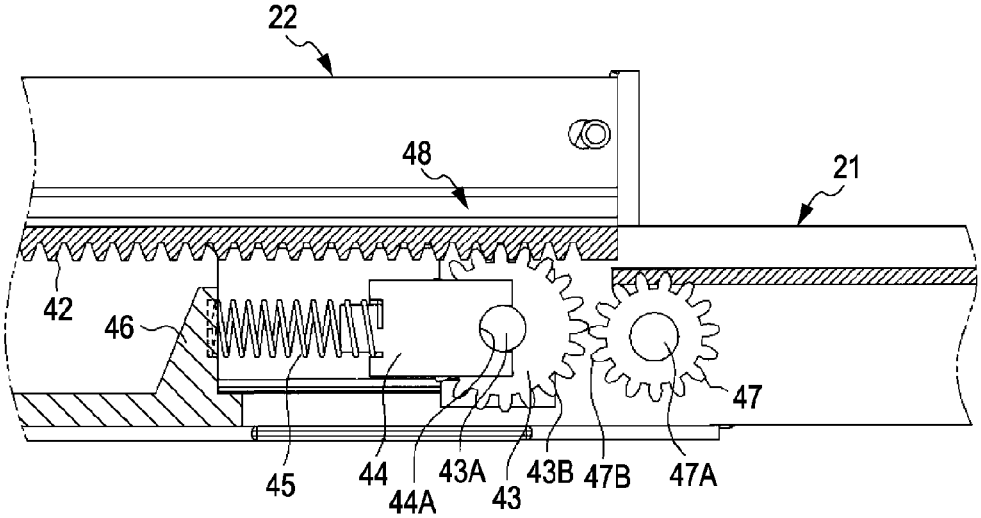

FIG. 6A and FIG. 6B are longitudinal cross-sectional views of the cassette, each of which is shown so that the power transmission mechanism is viewable. FIG. 6A is a view that shows a state in which the second tray is located at the retracted position (first position). FIG. 6B is a view that shows a state in which the second tray is located at the paper feeding position (second position). In addition, FIG. 7A and FIG. 7B are enlarged views, each of which shows the power transmission mechanism.

As shown in FIG. 6A to FIG. 7A, a pinion 43 is supported at one side portion of the first tray 21 and at the substantially center portion in the longitudinal direction thereof so that the pinion 43 can be displaced in the cassette insertion/removal direction with respect to the first tray 21. Specifically, a holder 44 is held at the side portion of the first tray 21 so that it can be displaced in the cassette insertion/removal direction, and a rotary shaft 43A of the pinion 43 is rotatably inserted in a bearing recess 44A that is recessed at the distal end portion of the holder 44 to the cassette insertion direction side.

A compression coil spring 45 is placed in a compressed state between a proximal end portion of the holder 44 (see FIG. 6A to FIG. 7A) and a support portion 46 on the first tray 21 side, and the holder 44 is urged by the elastic force of the compression coil spring 45 in the cassette insertion direction. Thus, the pinion 43 is urged in the cassette insertion direction by the elastic force of the compression coil spring 45 in a state where the pinion 43 is engaged with the rack 42.

The pinion 43 is configured to be engaged with a driving gear 47 that is arranged at a corresponding position in the printer 11 in a state where the cassette 16 is set in the mounting portion 12A. Thus, in the cassette 16, a region to the cassette insertion direction side of the pinion 43 is open as space for arranging the driving gear 47 when the cassette is mounted. Note that, in the present embodiment, the rack 42 and the pinion 43 constitute the power transmission mechanism 48.

The driving gear 47 is coupled through a group of gears (train of gears) (not shown) to a drive shaft of a tray switching motor 49 (shown in FIG. 9), which serves as a power source provided on the printer 11 side so as to be able to transmit power. In a state where the second tray 22 is located at the retracted position shown in FIG. 6A, as the tray switching motor 49 is driven in forward rotation and thereby the driving gear 47 rotates in forward rotation in a counterclockwise direction in the drawing, the pinion 43 rotates in forward direction in a clockwise direction in the drawing, so that the second tray 22 moves from the retracted position shown in FIG. 6A to the paper feeding position shown in FIG. 6B. In addition, in a state where the second tray 22 is located at the paper feeding position shown in FIG. 6B, as the tray switching motor 49 is driven in reverse direction and thereby the driving gear 47 rotates in reverse direction, the pinion 43 rotates in reverse direction, so that the second tray 22 moves from the paper feeding position shown in FIG. 6B to the retracted position shown in FIG. 6A.

As shown in FIG. 7A and FIG. 7B, when the cassette 16 is set in the printer 11, the teeth of 43B of the pinion 43 are not always engaged with the teeth 47B of the driving gear 47 but the edges of the teeth 43B and 47B may possibly abut against each other. In this case, if the cassette 16 is pushed in to the end of the stroke, an excessive load is applied between the abutted teeth 43B and 47B and, therefore, the teeth 43B and 47B may possibly be broken. However, in the present embodiment, the pinion 43 is supported so that it can be displaced in the cassette insertion/removal direction (lateral direction in FIG. 7A and FIG. 7B) and is urged by the urging force of the compression coil spring 45 in the cassette insertion direction (toward the right hand side in FIG. 7A and FIG. 7B). Thus, when the cassette is mounted, as shown in FIG. 7B, even when the edge of the teeth 43B of the pinion 43 abuts against the edge of the teeth 47B of the driving gear 47, because the pinion 43 retracts in a direction opposite to the cassette insertion direction against the urging force of the compression coil spring 45, an excessive load is avoided from being applied between the abutted teeth 43B and 47B. Then, after the cassette 16 is mounted, as at least one of the pinion 43 or the driving gear 47 slightly rotates, both the teeth 43B and 47B are engaged with each other by the urging force of the compression coil spring 45 as shown in FIG. 7A.

In addition, even when a user removes the cassette 16 during rotation of the driving gear 47, because the pinion 43 retracts against the urging force of the compression coil spring 45, an excessive load is avoided from being applied between the teeth 43B of the pinion 43 and the teeth 47B of the driving gear 47 when the cassette 16 is removed.

Figure 8:
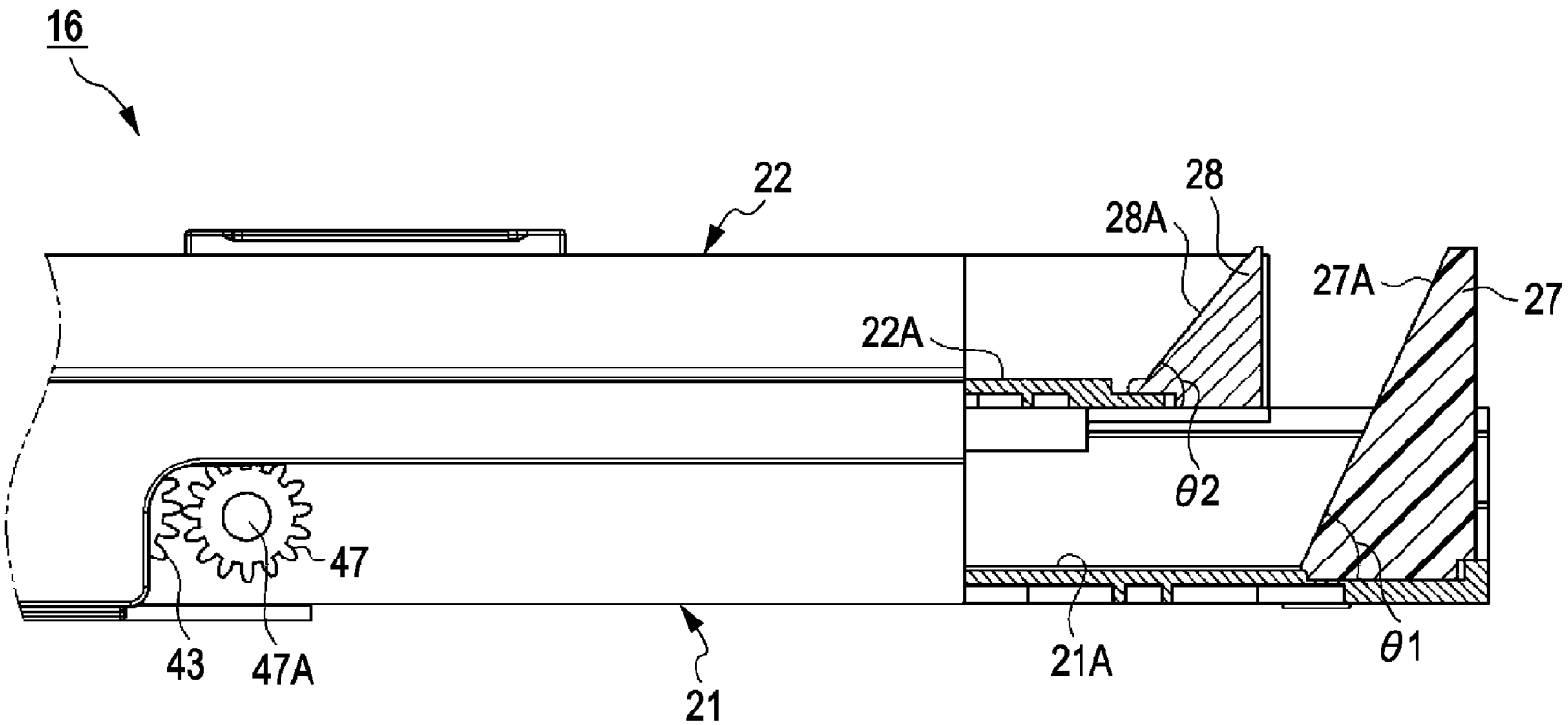
FIG. 8 is a partially longitudinal cross-sectional view of the cassette, which shows a separation portion provided for each tray.

FIG. 8 is a longitudinal cross-sectional view of a relevant part of the cassette with partially cut away. As shown in FIG. 8, in the present embodiment, the angle of inclination θ1 of the oblique surface 27A of the separation portion 27 that extends from the distal end portion to the cassette insertion direction side of the first tray 21 is different from the angle of inclination θ2 of the oblique surface 28A of the separation portion 28 that extends from the distal end portion to the cassette insertion direction side of the second tray 22. In the present embodiment, large-sized (A4 size in this embodiment) "plain paper" is assumed as a sheet of paper contained in the containing recess 21A of the first tray 21. On the other hand, small-sized "photo paper" (L size or 2L size) or "postcard" is assumed as a sheet of paper contained in the containing recess 22A of the second tray 22.

Here, when the distal ends of sheets of paper delivered by the pick-up roller 24 abut against the oblique surface 27A or 28A, the separation portion 27 or 28 has a separation function for separating the uppermost sheet of paper from other lower sheets of paper and a guide face function for guiding upward the separated uppermost sheet of paper along the oblique surface 27A or 28A toward an introducing portion between the paper feeding roller 32 and the paper feeding guide 31.

In the case when the paper is the sheet of paper P1 that is relatively thin and flexible as in the case of "plain paper", if the angle of inclination of the oblique surface 27A (angle gradient of the oblique surface) is relatively small, even when the distal ends of the sheets of paper P1 abut against the oblique surface 27A, the uppermost sheet of paper is hard to be separated from other lower sheets of paper. Then, even when the angle of inclination of the oblique surface 27A is made relatively large for easy separation, the separated uppermost sheet of paper bends and, therefore, is easily guided toward the introducing port along the oblique surface 27A. Thus, in regard to the first tray 21 for which sheets of paper, such as relatively flexible "plain paper", are used, the angle of inclination θ1 of the oblique surface 27A of the separation portion 27 is set for a relatively large angle.

On the other hand, in the case of the sheet of paper P2, which is relatively thick and hard as in the case of "photo paper" or "postcard", because it is easy to be separated, it can be separated even when the angle of inclination of the oblique surface 28A against which the distal end of the sheets of paper P2 abut is not set for a relatively large angle. However, when the angle of inclination of the oblique surface 28A is made excessively large, there is a possibility that the separated uppermost sheet of paper cannot be bent along the oblique surface 28A and, therefore, cannot be guided. Thus, the angle of inclination θ2 of the oblique surface 28A of the separation portion 28 of the second tray 22 for which the sheets of paper P2, such as relatively hard "photo paper" or "postcard", are used is set relatively smaller than the angle of inclination θ1 of the oblique surface 27A of the separation portion 27 of the first tray 21 for which the sheets of paper P1, such as relatively soft "plain paper", are used (θ1>θ2).

In addition, in the present embodiment, in consideration of the above points, the separation portions 27 and 28 employ different materials between the first tray 21 and the second tray 22. For example, the separation portion 28 of the second tray 22 for which hard sheets of paper P2 are used employs a material that tends to form a face having a relatively small coefficient of friction as compared with the separation portion 27 of the first tray 21 for which flexible sheets of paper P1 are used. An example of the material may be a polyacetal (POM) resin for the separation portion 28 of the second tray 22 for which hard sheets of paper P2 are used and an ABS resin for the separation portion 27 of the first tray 21 for which flexible sheets of paper P1 are used. Furthermore, at least the oblique surface 28A of the separation portion 28 is mirror-polished in order to reduce the coefficient of friction of the oblique surface 28A.

In addition, the length in which the separation portion 27 provided for the lower first tray 21 protrudes is relatively long, and the length in which the separation portion 28 provided for the upper second tray 22 protrudes is relatively short. Then, when the cassette 16 is mounted, the upper end positions of the two separation portions 27 and 28 are at substantially the same height to an extent that the separation portions 27 and 28 do not interfere with the introducing port side lower end of the paper feeding guide 31, shown in FIG. 2. Thus, the separation portion 27 when the first tray 21 is selected as a paper feeding tray (state shown in FIG. 3 or FIG. 6A) and the separation portion 28 when the second tray 22 is selected as a paper feeding tray (see FIG. 4 or FIG. 6B) each are located so that the upper end position is located near the introducing port side lower end of the paper feeding guide 31, so that the sheet of paper P1 or P2 separated by the separation portion 27 or 28 may be smoothly guided along the oblique surface 27A or 28A toward the introducing port. Note that the relative position between the first tray and the second tray when the second tray 22 is located at the retracted position corresponds to "first position", while, on the other hand, the relative position between the first tray and the second tray when the second tray 22 is located at the paper feeding position corresponds to "second position".

Figure 9:
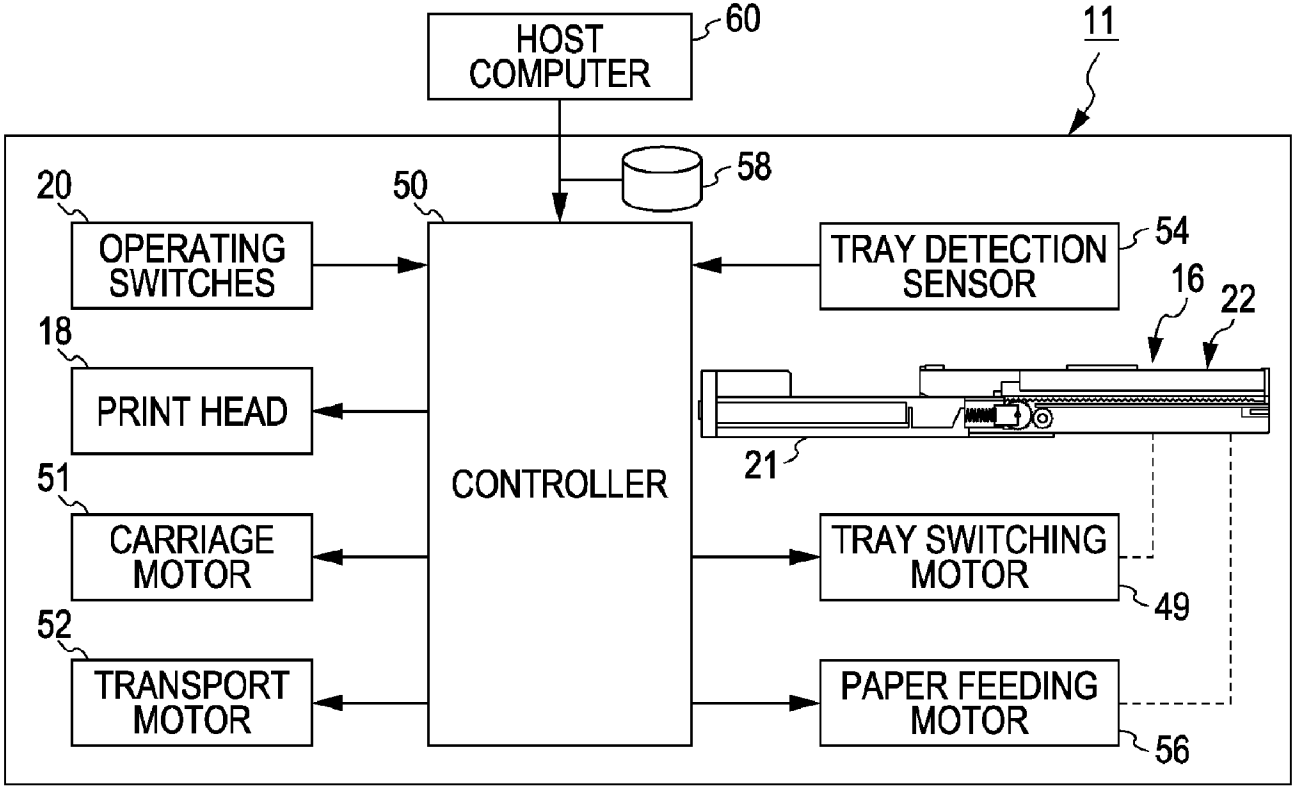
FIG. 9 is a block diagram that shows the electrical configuration of the printer.

FIG. 9 is a block diagram that shows the electrical configuration of the printer. The printer 11 is connected communicable with a host computer 60, such as a personal computer (PC), for example, and is used. The printer 11 internally includes a controller 50 that centrally controls the printer 11. The controller 50 internally includes, for example, a CPU, an ASIC (Application Specific IC), a ROM, a RAM, a flush memory (for example, EEPROM), and the like, and performs control of paper feeding operation, printing operation, paper transport operation, and the like, in the printer 11 in such a manner that the CPU executes a program that is read from the ROM or the flush memory. The operating switches 20, the print head 19, a carriage motor 51, a transport motor 52, a tray detection sensor 54, the tray switching motor 49 and a paper feed motor 56 are electrically connected to the controller 50.

The controller 50 has a buffer 58 that temporarily stores print data received from the host computer 60. The controller separates the print data received from the buffer 58 into a command and bitmap data and controls the print head 19 on the basis of the bitmap data to perform print operation. In addition, the controller 50, in accordance with the command, controls driving of the carriage motor 51 and the transport motor 52 to thereby control printing operation and paper transport operation. The controller 50, when performs paper feeding operation, drives the paper feed motor 56 and, by the driving of the paper feed motor, the pick-up roller 24 and the paper feeding roller 32 are driven for rotation in a direction in which sheets of paper can be delivered. Note that power from the paper feed motor 56 is transmitted to the pick-up roller 24 through a train of gears provided at the side portion of the lever 23.

Here, print data that are initially received by the printer 11 include information regarding paper type and paper size that are input by a user using an input device (a keyboard, a mouse, or the like) of the host computer 60. The controller 50 recognizes a paper feeding tray (feeding tray) that should be used for feeding sheets of paper from among the first tray 21 and the second tray 22 in the cassette 16 on the basis of the information regarding the paper type and the paper size.

The tray detection sensor 54 is a sensor that detects whether the second tray 22 is located at the retracted position shown in FIG. 3 or FIG. 6A or at the paper feeding position shown in FIG. 4 or FIG. 6B. The tray detection sensor 54 outputs a detection signal in accordance with each position. The controller 50 recognizes that the paper feeding tray is the first tray 21 on the basis of the detection signal when the second tray 22 is located at the retracted position or recognizes that the paper feeding tray is the second tray 22 on the basis of the detection signal when the second tray 22 is located at the paper feeding position. Then, the controller 50 determines whether the currently selected paper feeding tray coincides with the paper feeding tray determined on the basis of a sheet of paper specified. When the currently selected paper feeding tray does not coincide with the determined paper feeding tray, a tray switching process is performed so as to select a tray according to the specified sheet of paper as the paper feeding tray.

Figure 10:
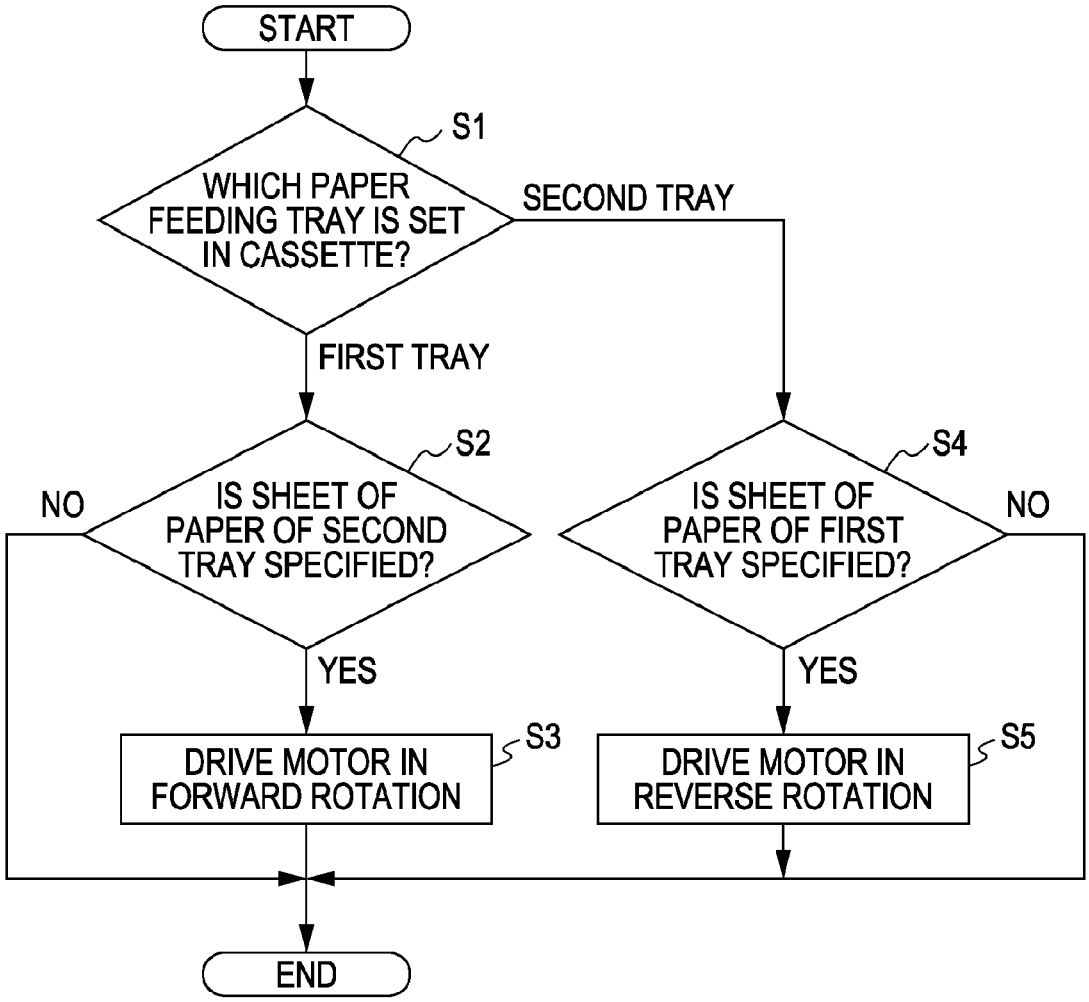
FIG. 10 is a flowchart that shows a tray switching process.

This tray switching process is performed in such a manner that the CPU in the controller 50 executes a program shown in the flowchart of FIG. 10. Hereinafter, the tray switching process will be described. As the CPU receives print data, at first, in step S1, it is determined which of the first tray 21 and the second tray 22 is the current paper feeding tray in the cassette 16. When the paper feeding tray is the first tray 21, the process proceeds to step S2, and then it is determined whether the sheet of paper of the first tray 21 is specified. For example, when the specified sheet of paper is paper type "photo paper" and paper size "L size", it is determined that the sheet of paper of the second tray 22 is selected. When the sheet of paper of the second tray 22 is specified, the process proceeds to step S3 and then the tray switching motor 49 is driven in forward rotation. As a result, the rotary force of the driving gear 47 is input to the pinion 43 and the pinion 43 is then rotated in forward direction. Thus, by the power transmitted through the rack 42, the second tray 22 moves from the retracted position to the paper feeding position and then the paper feeding tray is switched from the first tray 21 to the second tray 22. On the other hand, when the sheet of paper of the second tray 22 is not specified, the routine ends. That is, the state in which the paper feeding tray is the first tray 21 is maintained.

When the paper feeding tray is the first tray 21, as shown in FIG. 2, the pick-up roller 24 contacts on the upper face of the sheets of paper P1 on the first tray 21. Then, when the paper feed motor 56 is driven, the pick-up roller 24 and the paper feeding roller 32 are rotated, so that the uppermost sheet among the sheets of paper P1 is fed. At this time, the flexible sheets of paper P1 that have been fed by the pick-up roller 24 abut against the oblique surface 27A of the separation portion 27, which has a relatively large angle of inclination θ1, at their distal ends, so that the uppermost sheet of paper is reliably separated and is smoothly guided toward the introducing port between the paper feeding roller 32 and the paper feeding guide 31.

On the other hand, in step S1, when it is determined that the paper feeding tray is the second tray 22, in step S4, it is determined whether the sheet of paper of the first tray 21 is specified. For example, when the specified sheet of paper is paper type "plain paper" and paper size "A4 size", it is determined that the sheet of paper of the first tray 21 is selected. When the sheet of paper of the first tray 21 is specified, the process proceeds to step S5 and then the tray switching motor 49 is driven in reverse rotation. As a result, the rotary force of the driving gear 47 is input to the pinion 43 and the pinion 43 is then rotated in reverse direction. Thus, by the power transmitted through the rack 42, the second tray 22 moves from the paper feeding position to the retracted position and then the paper feeding tray is switched from the second tray 22 to the first tray 21. On the other hand, when the sheet of paper of the first tray 21 is not specified, the routine ends. That is, the state in which the paper feeding tray is the second tray 22 is maintained.

When the paper feeding tray is the second tray 22, as shown in FIG. 4 and FIG. 6B, the pick-up roller 24 contacts on the upper face of the sheets of paper P2 on the second tray 22. Then, when the paper feed motor 56 is driven, the pick-up roller 24 and the paper feeding roller 32 are rotated, so that the uppermost sheet among the sheets of paper P2 is fed. At this time, the hard sheets of paper P2 that have been fed by the pick-up roller 24 abut against the oblique surface 28A of the separation portion 28, which has a relatively small angle of inclination θ2, at their distal ends, so that the uppermost sheet of paper is reliably separated and is smoothly guided toward the introducing port between the paper feeding roller 32 and the paper feeding guide 31.

As described in detail above, according to the present embodiment, the following advantageous effects are obtained.

(1) When the cassette 16 is set in the mounting portion 12A of the printer 11, the power from the tray switching motor 49 provided on the main body 12 side is input from the driving gear 47 to the pinion 43 and then the power input through the pinion 43 to the power transmission mechanism 48 on the cassette 16 side moves the first tray 21 and the second tray 22 relative to each other. In this manner, in the cassette 16, the feeding tray is automatically switched between the first tray 21 and the second tray 22. Thus, it is not necessary to manually perform tray switching operation. In addition, because the cassette 16 does not need to have a power source, such as a tray switching motor, the cassette 1 may have a relatively simple configuration.

(2) Because the power transmission mechanism 48 that moves the first tray 21 and the second tray 22 relative to each other employs a rack and pinion mechanism formed of the rack 42 and the pinion 43, it is possible to avoid an increase in size of the cassette 16 as much as possible while achieving automatic switching of a tray.

(3) Because, in the cassette 16, a region to the cassette insertion direction side of the pinion 43 is open, when the cassette 16 is mounted on the printer 11, it is possible to engage the pinion 43 and the driving gear 47 in such a manner that the driving gear 47 on the main body 12 side is arranged in the open space to the cassette insertion direction side of the pinion 43. Thus, when a user only performs a normal operation that the cassette 16 is inserted into the mounting portion 12A, the pinion 43 may be engaged with the driving gear 47. Hence, it is not accompanied by an extra operation for connecting the power transmission mechanism 48 on the cassette 16 with the tray switching motor 49 on the main body 12 so as to be able to transmit power.

(4) The pinion 43 is provided so that it can be displaced in the cassette insertion/removal direction with respect to the first tray 21 and is urged by the elastic force of the compression coil spring 45, which serves as an urging device, in the cassette insertion direction. Thus, when the cassette 16 is mounted on the printer 11, even when the cassette 16 is pushed in to the end in a state where the teeth 43B of the pinion 43 are not engaged with the teeth 47B of the driving gear 47 but abut against the teeth 47B (state shown in FIG. 7B), the pinion 43 displaces in a direction opposite to the cassette insertion direction against the urging force of the compression coil spring 45. As a result, it is possible to avoid a large load from being applied between the teeth 43B of the pinion 43 and the teeth 47B of the driving gear 47, and it is possible to prevent breakage, or the like, of the teeth 43B and 47B. Then, when at least one of the pinion 43 or the driving gear 47 slightly rotates, because the pinion 43 is urged by the compression coil spring 45, it is possible to reliably engage the teeth 43*b* of the pinion 43 and the teeth 47B of the driving gear 47.

(5) The angle of inclination θ2 of the oblique surface 28A of the separation portion 28 provided for the second tray 22 in which relatively small-sized, thick and hard sheets of paper P2 are contained is set smaller than the angle of inclination θ1 of the oblique surface 27A of the separation portion 27 provided for the first tray 21 in which large-sized, thin and flexible sheets of paper P1 are contained. Thus, when the first tray 21 is selected as the paper feeding tray, flexible sheets of paper P1, such as A4 size plain paper, contained in the first tray 21 may be reliably separated by the oblique surface 27A of the separation portion 27, and the separated sheet of paper may be smoothly guided along the oblique surface 27A upward to the introducing port on the paper feeding roller 32 side. On the other hand, when the second tray 22 is selected as the paper feeding tray, relatively hard sheets of paper P2, such as photo paper or postcard, contained in the second tray 22 may be reliably separated by the oblique surface 28A of the separation portion 28, and the separated sheet of paper may be smoothly guided along the oblique surface 28A upward to the introducing portion on the paper feeding roller 32 side.

(6) Because the second tray 22, which is smaller than the first tray 21, moves relatively above the first tray 21, it is possible to eliminate an amount by which the second tray 22 protrudes with respect to the first tray 21 in position at which the second tray 22 is maximally moved relative to the first tray 21. Thus, the space for accommodating the cassette in the printer 11 may be relatively narrow and, hence, it contributes to a decrease in size of the printer 11.

Note that it is not limited to the above embodiment, but it may be modified into the following configurations.

First Alternative Embodiment

It is also applicable that the direction in which the first tray and the second tray are able to move relative to each other is a direction that intersects with the cassette insertion/removal direction. In short, it is sufficient when relative movement that switches between a state in which a medium may be delivered by the pick-up roller 24 and a state in which the medium is not delivered is possible.

Second Alternative Embodiment

The cassette may be configured to be further provided with a third tray in addition to the first tray and the second tray. In this case, the first to third trays may be arranged triple or the second tray and the third tray both may be arrange at the second step. Even when two trays are arranged at the same step, it is possible to employ an appropriate configuration that is able to switch trays so as to switch a medium on which the pick-up roller 24 contacts. For example, directions in which two trays arranged at the same step move may be configured to be perpendicular to each other. That is, above the tray at the first step, one tray moves relatively in the cassette insertion/removal direction and the other tray moves relatively in a direction perpendicular to the cassette insertion/removal direction (widthwise direction). Of course, the cassette is not limited to the three tray configuration but it may also employ four or more tray configuration.

For example, when three or more trays are employed, the rack and pinion mechanism is provided each between the trays, and a plurality of driving gears corresponding to the pinions are provided on the main body side. In addition, it is applicable that a clutch device that is able to selectively switch a pinion to which power is input among a plurality of pinions is provided and the pinion to which power from the driving gear is input is selected by switching of the clutch device. Furthermore, it may employ a power transmission mechanism in which a driven gear on the cassette side, which engages the driving gear, is only one and, by driving the driven gear, the feeding tray is switched in the order of the first tray, the second tray, the third tray, . . . . For example, by interposing a reduction gear mechanism between the trays, a moving speed is varied among the trays. Thus, sheets of paper on the tray reach a position at which the sheets of paper on the tray contact the pick-up roller in the order of the first tray, the second tray, the third tray, . . . . Note that the orientation in which the cassette is mounted is not limited to the horizontal, but the cassette may be, for example, mounted vertically.

Third Alternative Embodiment

In the present embodiment, the controller 50 determines the specified sheet of paper and performs control to switch the relative position of the trays so that the tray corresponding to the determined sheet of paper is selected as the paper feeding tray; however, for example, it is also applicable that the tray switching motor is driven in such a manner that a user operates a switch provided on the main body of the printer to thereby switch the paper feeding tray.

Fourth Alternative Embodiment

The plurality of trays provided for the cassette are a combination of the first tray, which is a large-sized tray that contains large-sized sheets of paper, and the second tray, which is a small-sized tray that contains small-sized sheets of paper; however, for example, a combination of trays, each of which contains the same size sheets of paper, may also be employed. In this case, sheets of paper of different types may be contained; however, it may be configured so that sheets of paper of the same types are contained and, when sheets of paper in one of the trays are empty, sheets of paper in the other tray are used.

Fifth Alternative Embodiment

The power source is not limited to a motor exclusive to the cassette, such as the tray switching motor 49. For example, another motor, such as the paper feed motor 56, the carriage motor 51 or the transport motor 52, may double as a power source for driving a tray in the cassette 16.

Sixth Alternative Embodiment

The power transmission mechanism is not limited to the mechanism that is provided with the rack and the pinion. For example, a power transmission mechanism that is provided with a roller, a pulley or a sprocket, which loops a belt, a wire or a chain, to move a tray in a belt system, a wire system or a chain system may be employed. That is, as the roller, the pulley or the sprocket that loops the belt, the wire or the chain is driven for rotation by the power input from the driving gear to the power transmission mechanism, the first tray and the second tray move relative to each other by means of the belt system, the wire system or the chain system.

Seventh Alternative Embodiment

In the present embodiment, the power source is provided on the main body side of the image forming apparatus body side; however, it is applicable that the power source is provided on the cassette side. In this case, a connector is provided on the cassette and is electrically connected to a connector of the main body side by mounting the cassette, and, for example, it is also applicable that the power source (tray switching motor) on the cassette is controlled for driving by the controller on the main body side.

Eighth Alternative Embodiment

The image forming apparatus is not limited to an ink jet printer (liquid ejecting apparatus), but it may be, for example, a dot-impact printer, a laser printer, a thermal imprint recording printer, or the like. In addition, the image forming apparatus is not limited to a serial printer, but it may be applied to a line printer. Furthermore, the image forming apparatus is not limited to a printer, but it may be a scanner. That is, the aspects of the invention may be applied to a cassette used for a scanner. In the case of the scanner, the process in which an image of an original is read and then data of the image are generated corresponds to image forming.

Hereinafter, technical ideas that are understood from the above embodiment and the above alternative embodiments will be described.

(1) In the cassette according to the aspect of the invention, the first tray and the second tray may be movable relative to each other in the cassette insertion/removal direction.

(2) In the cassette according to the aspect of the invention, wherein the image forming apparatus may be provided with a pick-up roller, and wherein, when the cassette is mounted on a image forming apparatus body, the first tray and the second tray move relative to each other between a first position at which media on the first tray contacts the pick-up roller and a second position at which media on the second tray contacts the pick-up roller.

(3) In the cassette according to the aspect of the invention, wherein the first tray and the second tray may be arranged double in a direction in which media are loaded, wherein the second tray may be a small-sized tray of which the size of a containable medium is smaller that that of the first tray, and wherein the second tray may be configured to be movable relative to the first tray.

According to the above aspect, because the second tray, which is smaller than the first tray, moves relatively above the first tray, it is possible to eliminate or reduce as much as possible an amount by which the second tray protrudes with respect to the first tray in position at which the second tray is maximally moved relative to the first tray. Thus, the space for accommodating the cassette in the image forming apparatus may be relatively narrow.

(4) In the cassette according to the above technical idea (3), the second tray may have a pivot cover that is pivotable so that the second tray partially opens a portion thereof, which covers the first tray.

(5) The image forming apparatus according to the aspect of the invention may further includes a control device that controls to drive the power source so that it is determined what medium size is specified on the basis of image forming instruction information received and, when it is determined that, between the first tray and the second tray, a tray that is selected as a paper feeding tray to feed a medium is not a tray corresponding to the specified medium size, a relative position between the first tray and the second tray is switched between the first position and the second position to a position at which the tray corresponding to the specified medium size is selected as the paper feeding tray.

What is claimed is:

1. A cassette that is used by being mounted on an image forming apparatus body and can be accommodated in a state where media, which will be supplied to the image forming apparatus body, are loaded, the cassette comprising:

a first tray that is able to contain multiple media;

a second tray that is able to contain multiple media;

a slide mechanism that allows the first tray and the second tray to be movable relative to each other;

a power transmission mechanism including a rack and a pinion, where the rack is provided for one of the first tray and the second tray, and the pinion comprising a gear provided for the other of the first tray and the second tray, and an urging device that urges the pinion in the cassette insertion direction when the cassette is inserted, wherein the pinion is engaged with the rack, such that when the pinion receives the input power, the first try and the second tray are moved relative to each other.

2. The cassette according to claim 1, wherein the pinion is at least open to a cassette insertion direction side.

3. An image forming apparatus comprising:

the cassette according to claim 1; and an image forming apparatus body that has a mounting portion on which the cassette can be mounted, wherein the image forming apparatus body is provided with a driving gear that is engaged with the power transmission mechanism so as to be able to transmit power in a state where the cassette is mounted on the mounting portion.

4. The image forming apparatus according to claim 3, wherein the image forming apparatus body includes a power source that outputs power for rotating the driving gear, and wherein in a state where the cassette is mounted on the mounting portion, a rotary force of the driving gear on the basis of the power of the power source is transmitted to the power transmission mechanism that is engaged with the driving gear to thereby move the first tray and the second tray relative to each other.

5. The image forming apparatus according to claim 3, wherein the image forming apparatus body includes a pick-up roller that is driven so as to be able to deliver media on the cassette that is mounted on the mounting portion, wherein the first tray and the second tray, when the cassette is mounted, are movable relative to each other between a first position at which the pick-up roller contacts an uppermost medium among media loaded on the first tray and a second position at which the pick-up roller contacts an uppermost medium among media loaded on the second tray, and wherein a tray from which the pick-up roller delivers media is switched in such a manner that a relative position between the first tray and the second tray is switched between the first position and the second position by power input to the power transmission mechanism.

* * * * *